US005575019A

United States Patent [19]

Kijewski

[11] Patent Number: 5,575,019

[45] Date of Patent: Nov. 19, 1996

[54] TOILET VENTILATION SYSTEM

[76] Inventor: Robert J. Kijewski, 329 Queen St., Woodbury, N.J. 08096

[21] Appl. No.: 881,725

[22] Filed: May 11, 1992

Related U.S. Application Data

[63] Continuation-in-part of Ser. No. 658,955, Feb. 22, 1991, abandoned.

[51] Int. Cl.[6] ..... E03D 9/04

[52] U.S. Cl. ..... 4/209 R; 4/213

[58] Field of Search ..... 4/213, 218, 347, 4/209–211, DIG. 19

[56] References Cited

U.S. PATENT DOCUMENTS

| | | | |
|---|---|---|---|
| 2,396,371 | 3/1946 | Harbeke | 4/218 |
| 3,495,281 | 2/1970 | Palowsky | 4/211 X |
| 3,571,822 | 3/1971 | Shaw | 4/213 |
| 3,873,445 | 3/1975 | Bussard | 4/347 X |
| 3,939,506 | 2/1976 | Pearson | 4/213 |
| 4,313,233 | 2/1982 | Roberts | 4/DIG. 19 |
| 4,324,007 | 4/1982 | Morris | 4/321 |
| 4,880,027 | 11/1989 | Menge | 4/213 X |
| 4,974,632 | 12/1990 | Ericson | 4/218 X |

*Primary Examiner*—Charles E. Phillips
*Attorney, Agent, or Firm*—Norman E. Lehrer

[57] ABSTRACT

A toilet such as used with a recreational vehicle, camper or motor home or the like includes a holding tank located beneath the toilet for holding waste. A mechanical seal associated with the toilet prevents gases from the holding tank from entering the room where the toilet is located. The mechanical seal which must be opened periodically when the toilet is used activates a fan in the sanitary system ventilation piping to thereby cause air to flow from the room into the toilet and through the holding tank and ventilation system to the outside atmosphere. A strainer or screen which may be located either between the toilet opening and the vent opening in the tank or further upstream of the ventilation fan prevents solids from being drawn into the vent piping and operating mechanism, respectively. A mist extractor chamber upstream of the fan in the vent piping removes vapors from the flow of gases. Also to clean the vent pipe a cleanout and purge fitting is installed there. The ventilation system is provided with a vacuum relief to keep negative pressure to a minimum and a mechanical device to produce an audible warning when the relief valve opens. An alternative to relief/mechanical audible warning could be a vacuum switch that senses an abnormally low pressure in the vent piping and would energize a warning light/horn and/or shut down the fan. Likewise, a level switch could shut down the fan during a high level and/or energize a high level warning light or horn. A holding tank level indicator is used for dependable gauging of the tank level.

13 Claims, 1 Drawing Sheet

TOILET VENTILATION SYSTEM

CROSS-REFERENCE TO RELATED APPLICATION

This application is a continuation-in-part of prior U.S. application Ser. No. 658,955, filed Feb. 22, 1991 now abandoned.

BACKGROUND OF THE INVENTION

The present invention is directed at preventing sanitary system gases of RV's (recreational vehicles), trailer homes and the like from passing through the toilet's waste-passage and into the room where the toilet is located. It is also intended to adapt powered ventilation to such sanitary systems so as to prevent incurred problems due to this addition.

Typically there are two types of toilets in regards to their method of preventing sanitary system gases from passing through them and into the room where they are used. They are the water-trap-toilet and the mechanical-seal-toilet. The water-trap-toilet is generally used in permanent structures while the mechanical-seal-toilet is generally used in conveyances such as RV's. Water-trap-toilets provide a continuous positive seal between the toilet room and the sanitary system by trapping flushing water in its waste passage. Mechanical-seal-toilets provide a seal between the toilet room and the sanitary system with a valve located in its waste passage. When the valve is open, however, this seal is broken and communication between the room and sanitary system can occur.

Conventional sanitary systems typically used in recreational vehicles, trailer homes and the like consist of a holding tank located beneath the floor of the facility and a mechanical seal type toilet fixture. From time to time, to prevent over-filling, the holding tank contents are emptied through the tank drain piping and disposed of. Tank level is gauged by viewing it through the toilet waste passage. A vent line off the tank provides an inlet so that the contents are displaced by outside air during tank draining. Gases in the holding tank are prevented from entering the room within which the toilet is located by the toilet outlet valve located in the toilet's waste passage. However, when the valve is opened to empty the toilet's bowl, these objectionable gases can pass through this passage and into the facilities room.

It is proposed to add to such a system's vent piping a fan for the purpose of venting the toilet when its waste outlet valve is open. This would prevent tank gases from entering the facilities room during that time. The tank used in a conventional sanitary system is box shaped and located below the floor of the facilities enclosure to conserve space. The tank's toilet and vent openings are located on the tanks top side. This configuration presents a problem as the location of the vent opening is lower than the toilet outlet valve. This allows the tank to be filled to the top. When tanks are full or contents are in close proximity to the suction at the tank vent opening they can be sucked into the vent piping.

U.S. Pat. No. 3,571,822 to Shaw describes a mobile type sanitary system that ventilates an unconventional mechanical seal type toilet. Here ventilation occurs during use and during the flushing operation. Shaw does not describe his toilet's adaptability to a conventional system used in RV's, trailer homes and the like. He does suggest that the tank could be separate from the toilet but he does not show how it would be constructed or piped to a conventional system. The preferred embodiment shows the toilet and tank as one unit. In this configuration there is no problem as to the contents getting near enough to be sucked into the tank's vent opening as the tank vent opening is above the toilet outlet valve. This would be a problem with a conventional system as explained in the previous paragraph. A problem Shaw does not consider. It should be apparent to those skilled in the art that Shaw's invention would not be workable or dependable in a conventional sanitary system or system that allows toilet discharge or tank contents to get in close proximity to the systems vent take off. It is also unlikely the preferred embodiment of Shaw's invention would be used in a modern RV or house trailer as the utilization of space is a primary consideration in their design.

Shaw's invention would be complex and expensive to adapt to existing built or newly manufactured conventional type sanitary facilities. It would be expensive because adapting to an existing system would require the replacement of the conventional toilet with one capable of operating like Shaw's proposed system. Assuming his toilet were adapted to a conventional system and affixed to the standard connection off the holding tank it is likely that additional piping to the toilet would be necessary. This piping would be for the venting path to remove user generated gases during toilet use. The cost of the electrical controls is another factor. Its operation is complex. There are two switches to energize the venting fan. One switch is operated by the toilet's lid and the other by the flushing mechanism. The switch operated by the toilet's lid also energizes a solenoid valve. This valve is located in the venting path and allows ventilation of the bowl during use and would be a component of his toilet. Special considerations for the installation of the valve and switches would be necessary to meet electrical safety, operating and maintenance requirements. This venting path could also be a place where odors or insects are generated given the possibility of wastes or other material entering there.

In addition Shaw's toilet is unconventional in that it cannot have a toilet bowl cover due to its mode of operation. This is also true of the toilet seat which normally is left in the vertical position when not in use.

Ventilation of bowls of water-trap-toilets have been proposed in U.S. Pat. Nos. 1,401,091; 3,571,824; 3,192,539, and 3,938,201 and have found little or no use. Room ventilating fans have proved satisfactory for removing facility-user generated gases.

The Anderson U.S. Pat. No. 4,894,872 is not designed to prevent odors from passing through the toilet's waste passage. It is a waterless system that uses a toilet that provides no seal against odors. Ventilation through the toilet also is not a consideration as its waste receptacle has several inlet openings to the outside atmosphere. The toilet used in this system is a straight through open type as used in latrines. Preventing flow through the toilet in the direction of its enclosure is not indicated in the patent. Air flow through the toilet is not indicated in his patent. Ventilation of the waste receptacle is primary to reducing odors while increasing evaporation and decomposition of waste.

Harding's U.S. Pat. No. 4,922,557 is a holding tank ventilation system. It incorporates a solar powered fan that when operating is intended to reduce odors by introducing cooler air into the holding tank. This system uses a open toilet with no sealing means. Even if ventilation were continuous the inventor does not indicate ventilation as a means to prevent tank odors from passing through the toilet.

Bussard's U.S. Pat. No. 3,873,445 is not directed at ventilation of a mechanical seal type toilet as he utilizes a water-trap type toilet in his invention. If a mechanical seal toilet were used in his facility, proper ventilation would not be possible as there is no negative pressure in the waste receptacle.

Ellis' U.S. Pat. No. 3,570,016 shows a portable toilet system that uses an open toilet as found in latrines. Powered ventilation of the toilet is not indicated in the patent. A room ventilation fan is used only for the ventilation of the toilet's enclosure. It is possible that if the sealing lid of the toilet were open that this fan could draw the gases of the system into the toilet's enclosure. In any event, communication between the enclosure and system is possible when the toilet's sealing lid is open.

SUMMARY OF THE INVENTION

The present invention is directed at preventing sanitary system gases of RV's and the like from passing through the system's toilet and into the room where the toilet is located. It is also intended to remedy all problems and deficiencies of the prior art in these regards. This is possible with practically no changes to the basic construction and make-up of such conventional systems.

It is proposed to add a fan in the vent piping of such systems and coordinate it to run when the toilet outlet valve is open. This action creates a negative pressure in the system and effects the air within the toilet's enclosure to flow into the toilet's waste passage. Single direction flow through the toilet outlet valve prevents sanitary system gases from entering the toilet's enclosure. Fan selection and sizing would insure proper flow rates during normal operation.

This invention is a development of the principle of purging one gas with another and applying it to conventional sanitary systems of RV's and the like. It is referred to here as "powered ventilation." Conventional systems make no considerations in their construction for the addition of powered ventilation. Holding tanks of existing conventional systems can be filled to capacity with no ill effects to the vent piping. This condition though would make powered ventilation as proposed problematic as tank contents could be sucked into the vent piping.

The invention shows several ways to insure its proper operation. Solids are prevented from entering the vent piping by installing a strainer between the tank's vent and toilet openings. Liquids and vapors are prevented from passing through the vent piping and discharged outside by installing a mist extractor to remove liquids and vapors flowing in that piping. Indication and pressure relief due to a closed system upstream of the fan suction can be incorporated in several ways. A vacuum breaker valve with integral pneumatic whistle would open when abnormally low negative pressure is sensed in the vent piping. This would reduce suction at the tank vent opening by opening a path to atmosphere. Flow through this valve would also create a warning sound. Likewise a vacuum switch could electrically warn and shut down the fan during abnormally low negative pressure in the vent piping. Abnormally low negative pressure can occur when tank level restricts flow between the toilet and vent openings in the tank. Other examples are: if the vent piping becomes plugged or the toilet's outlet valve malfunctions. To warn of a high level in the tank that threatens the operation of the ventilation system a level switch could be installed on the tank to give warning that the tank should be emptied.

Other elements of the invention include a hose connection and clean-out opening for flushing and mechanically cleaning the vent piping.

BRIEF DESCRIPTION OF THE DRAWING

For the purpose of illustrating the invention, there is shown in the accompanying drawing one form which is presently preferred: it being understood that the invention is not intended to be limited to the precise arrangements and instrumentalities shown.

DETAILED DESCRIPTION OF THE PREFERRED EMBODIMENT

Figure 1:
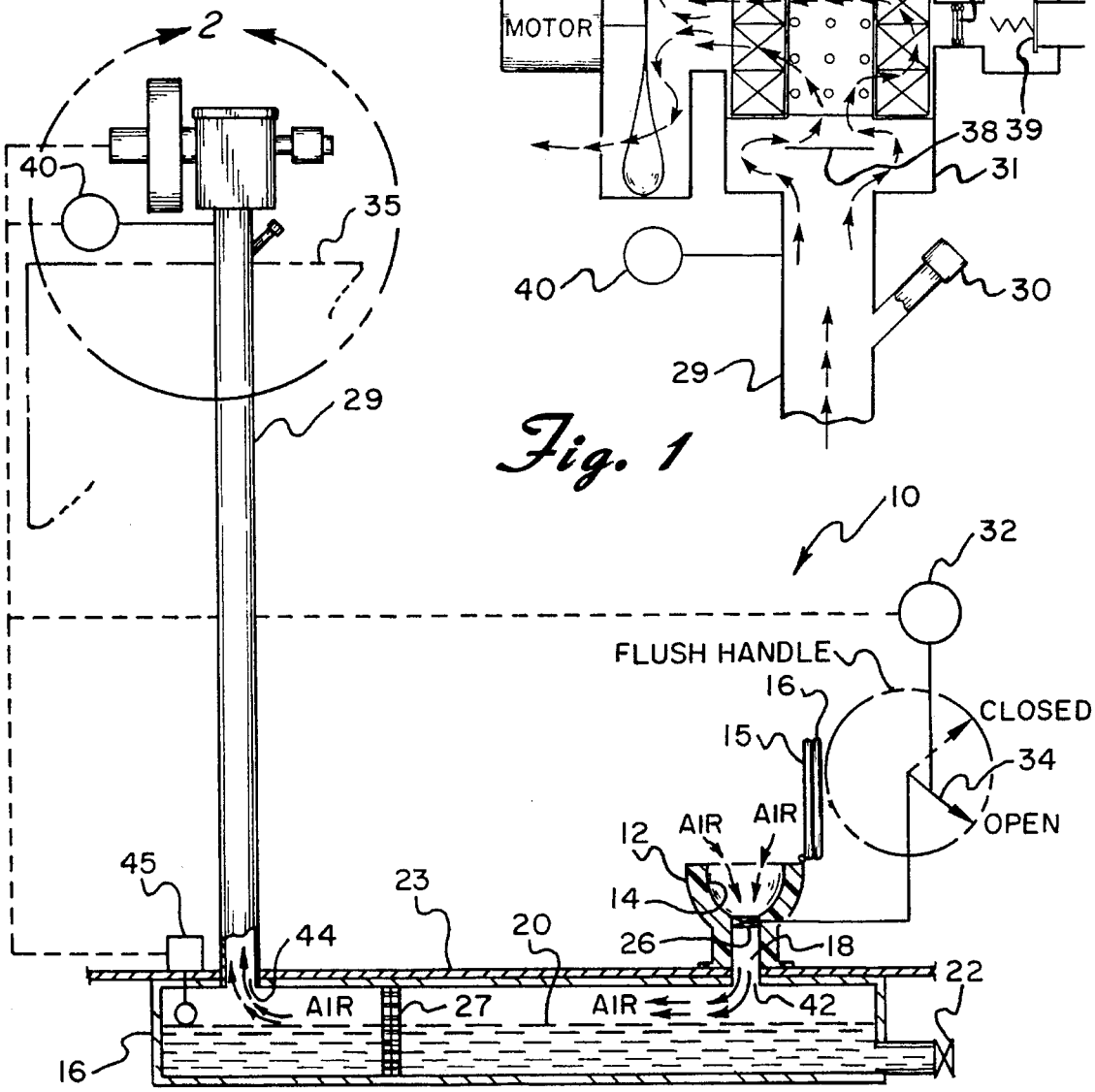
FIG. 1 is a schematic representation shown partly in cross section of a toilet ventilation system constructed in accordance with the principles of the present invention.
Figure 3:
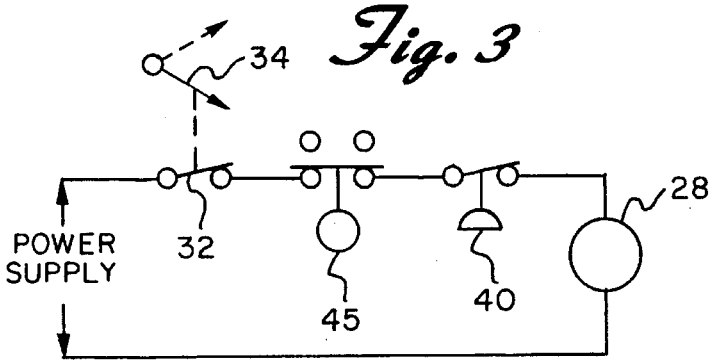
FIG. 3 is a schematic drawing of the electrical circuit employed in the facility shown in FIG. 1.

Referring now to the drawing in detail wherein like references numerals have been used throughout the figures to designate like elements, there is shown in FIG. 1 a schematic representation of the toilet ventilation system constructed in accordance with the principles of the present invention and designated generally as 10. The system 10 includes a conventional mechanical seal toilet 12 with conventional seat 15 and lid 16. The toilet 12 is located above floor 23 and a receptacle such as holding tank 16 below so that waste from the toilet can pass downwardly through the passageway 18 and into the holding tank 16.

FIG. 1 shows a quantity of waste material 20 accumulated in the holding tank 16. From time to time, the waste material is drained or pumped out of the holding tank 16 through drain piping 22.

The sanitary system 10 also includes a ventilating means in the form of vent piping 29. Vent piping 29 provides a conduit between the interior of the holding tank 16 and the outside atmosphere.

In order to prevent gases contained in tank 16 from passing up through passageway 18, bowl 14 and into toilet enclosure 35, the toilet 12 is provided with a valve 26. This valve 26 is normally closed and holds the contents deposited in the bowl 14 such as waste or toilet rinse water. However when the valve 26 is opened to discharge the contents of the bowl 14, communication is open between the interior of the holding tank 16 and the enclosure 35.

The system thus far described under this heading and shown only as elements: vent piping 29, tank 16, toilet 12 and drain piping 22 in FIG. 1 is generally representative of a conventional sanitary system used in RV's, trailer homes and the like. The specific details of the construction thereof and the details of operation are well known to those skilled in the art. It is for this reason that the system is shown only schematically.

Applicant's improvements are directed at preventing noxious gases and the like from within the holding tank 16 from passing up through the toilet's passage 18 and contaminating the air in the facility enclosure 35 when valve 26 is open. To this end, the vent piping 29 is provided with an electrically operated evacuating fan 28. Fan 28 is operable to draw the gaseous contents of the system upwardly from the holding tank 16 through the vent piping 29 and to exhaust the same out to the atmosphere. Fan 28 essentially reduces the air pressure within the vent piping 29 and the holding tank 16 by drawing air upwardly as shown by the arrows within the holding tank and vent piping. Of course, it should be understood that the fan 28 is shown in symbol form and does not indicate the type of fan.

Since there is no communication between the interior of the tank 16 and the room when valve 26 is closed, there is normally no need to activate the fan 28 but there is communication when the valve 26 is in an open position. The system is, therefore, provided with a switch 32 that starts the fan 28 upon the opening of valve 26 by the manual operation of the toilet's flush handle 34. The handle in FIG. 1 is shown indicating the valve 26 is in the full open position. Contacts of switch 32 are normally open but are closed by the operation of the normally closed spring return valve 26. This can easily be accomplished as shown in FIG. 1 by a simple linkage between the switch 32 and the handle 34. Similarly, the switch 32 could be associated more directly with the valve 26 through a linkage which specifically senses when the valve 26 opens and closes rather than when the handle 34 is moved. In either case, the fan 28 will be activated only when the valve 26 is opened otherwise the fan 28 will be off.

As should be readily apparent to those skilled in the art is that when the toilet 12 is flushed opening valve 26 and activating fan 28, a reduced pressure is created in the vent piping 29 and in the holding tank 16. This causes fresh air to flow from the toilet facility enclosure 35 and pass through the toilet 12, holding tank 16 and then flow through the vent stack 29 to be discharged to the outside atmosphere by fan 28. The volume of flow created by fan 28 into passage 18 is such as to prevent any holding tank gases from moving upwardly through the toilet 12. This flow of air and gases is illustrated by the arrows in FIG. 1.

Again the primary consideration of this invention is to prevent septic gases of conventional sanitary system used in RV's and the like from entering the toilet enclosure via the toilet's waste passage. To adapt power ventilation to such a system for this purpose and make it functional it is necessary to prevent tank contents in the form of solids and liquids from entering into the vent piping. This can occur during tank high levels or if contents are near the tank vent opening during fan operations. This can cause a multitude of problems some of which are: plugging the vent piping, discharge of tank contents to the outside and damage to the fan. It is also necessary to address the problem of flow restriction due to high tank levels or system malfunction.

It is also advantageous, especially where adapting power ventilation to existing systems, to include clean-out and flushing connections on the vent piping.

The holding tank 16 receives the discharges of toilet 12; principally human waste, paper and toilet rinse water. The invention prevents solids from entering the vent piping 29 through tank vent opening 44 by partitioning tank 16 between tank opening 44 and tank opening 42 with strainer 27. This allows only liquids to pass to the vent opening side of tank 16. It may be acceptable to have only a strainer 33 located in the vent piping for this purpose in existing constructed sanitary systems.

In the event vent piping 29 requires cleaning a clean-out opening with a cover 36 and flushing connection 30 is provided on the vent pipe 29.

Figure 2:
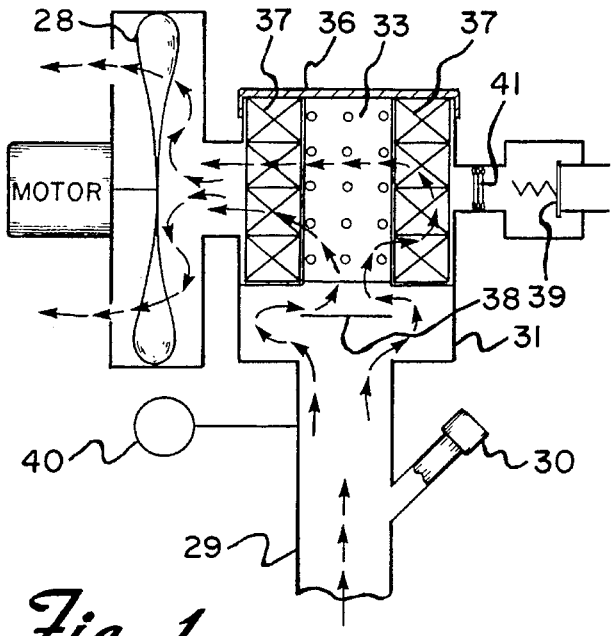
FIG. 2 is an enlarged cross section of the assembly located above the roof of the enclosure and at the top of the vent piping which contains the fan.

During high tank levels the flow of gases through the tank 16 during fan operation can entrain liquids. The invention prevents these liquids from being discharged to the outside atmosphere by installing a mist extractor 37 upstream of the fan 28 in the vent piping 29. An impingement type extractor using a wire mesh element is shown in FIG. 2. A diverter plate 38 is also added to help liquidgas separation.

Warning of vent 29 plugging, warning of flow restriction due to high tank 16 levels and pressure relief is accomplished with a vacuum breaker valve 39 and pneumatic whistle device 41 on the vent piping 29. The opening of valve 39 allows outside air to flow through the warning whistle 41 and into the vent system during abnormally low pressure in the vent piping 29. This reduces suction at the system vent take-off 44 and reduces the risk of fouling. A vacuum switch 40 for fan shutdown and or low pressure alarming is another alternative to the above.

Level switch 45 can operate a warning horn or light to warn of high level in tank 16, which can cause excessive flow restriction and liquid entrainment of the flowing gases through tank 16. Level switch 45 can also be wired to shut down the fan when tank 16 level prevents the proper operation of the system. During fan 28 shutdown gases can pass through the toilet 12 and into the enclosure 35. Only by draining the tank 16 to a lower level will switch 32 energize the fan.

The present invention may be embodied in other specific forms without departing from the spirit or essential attributes thereof and accordingly reference should be made to the appended claims rather than to the foregoing specification as indicating the scope of the invention.

I claim:

1. In a conventional sanitary system in a recreational vehicle including a conventional mechanical seal toilet located within an enclosure and a holding tank located below the floor of the enclosure and having the toilet, vent piping and a tank drain connected to the holding tank, with the vent piping extending upwardly to the exterior of the enclosure, the improvement being the addition of a venting means installed in the vent piping adjacent the top thereof and energized to reduce pressure in the system when the toilet seal is open to thereby prevent gases in the holding tank from communicating with the facility enclosure via the toilet, said toilet and vent piping being connected to said holding tank through a toilet opening and vent opening, respectively, and further including a strainer means between said toilet opening and said vent opening to prevent solids from getting near to said vent opening.

2. The invention as claimed in claim 1 further including means for reducing the suction within said vent piping upon the indication of a restriction to flow in the system.

3. The invention as claimed in claim 1 including a mist extraction means upstream of the venting means and adjacent the top of the vent piping to remove entrained liquids to prevent them from entering said venting means or from being discharged outside.

4. The invention as claimed in claim 1 including a strainer means upstream of the venting means and adjacent the top of the vent piping to prevent solids from the tank from entering the venting means.

5. The invention as claimed in claim 1 including a clean-out opening at the top of the vent piping to allow for the mechanical cleaning of the vent piping upstream of the venting means.

6. The invention as claimed in claim 1 including a flushing connection upstream of the venting means and adjacent the top of the vent piping.

7. The invention as claimed in claim 1 including a vacuum relief means to reduce suction within the vent piping when the tank vent opening or piping becomes restricted by tank contents or other system malfunction.

8. The invention as claimed in claim 7 including a pneumatic whistle located between the vacuum relief means and the vent piping to provide an audible warning of a malfunction indicated by activation of the vacuum relief means thereby causing air to flow through it and continue through the whistle, vent piping and venting means.

9. The invention as claimed in claim 1 including a level indicator means for gauging the liquid level in the holding tank.

10. The invention as claimed in claim 1 further including a liquid level switch to deactivate the venting means when the liquid in said tank reaches a predetermined level, said liquid level switch being located in said tank between said vent opening and said strainer means.

11. The invention as claimed in claim 1 further including a liquid level switch to activate an alarm when the liquid in said tank reaches a predetermined level, said liquid level switch being located in said tank between said vent opening and said strainer means.

12. The invention as claimed in claim 1 further including electrical switch means for energizing said venting means when said toilet sealing means is open.

13. The invention as claimed in claim 1 further including a vacuum switch on said vent piping to deactivate the venting means upon the indication of a restriction to flow in the system.

* * * * *